US005653136A

United States Patent [19]

Huang

[11] Patent Number: 5,653,136

[45] Date of Patent: Aug. 5, 1997

[54] LOCATING DEVICE FOR NUMERAL WHEEL OF NUMERAL LOCK

[76] Inventor: Chien-Yung Huang, No. 40, Jaw-An Street, Taipei, Taiwan

[21] Appl. No.: 395,953

[22] Filed: Feb. 28, 1995

[51] Int. Cl.[6] ..... E05B 37/02

[52] U.S. Cl. ..... 70/312; 70/317; 70/327

[58] Field of Search ..... 70/312–319, 325, 70/326–328, 438, DIG. 21, DIG. 25, DIG. 44

[56] References Cited

U.S. PATENT DOCUMENTS

| | | | |
|---|---|---|---|
| 730,719 | 6/1903 | Taylor | 70/317 |
| 1,094,735 | 4/1914 | McChesney | 70/328 |
| 1,240,114 | 9/1917 | Baum | 70/317 |
| 1,313,536 | 8/1919 | Jay | 70/327 X |
| 1,410,033 | 3/1922 | Pass | 70/317 X |
| 1,497,793 | 6/1924 | Saunders et al. | 70/328 X |
| 1,583,688 | 5/1926 | Hatch | 70/328 X |
| 1,924,987 | 8/1933 | Furino | 70/328 X |
| 1,928,853 | 10/1933 | Doenges | 70/316 X |
| 3,473,354 | 10/1969 | Hutchins | 70/328 X |
| 4,259,856 | 4/1981 | Wingert | 70/327 X |
| 4,312,199 | 1/1982 | Uyeda | 70/316 |
| 4,445,348 | 5/1984 | Saitoh | 60/319 X |
| 4,644,767 | 2/1987 | Dueringer | 70/327 X |
| 5,027,623 | 7/1991 | Ling | 70/328 X |
| 5,235,831 | 8/1993 | Lauria et al. | 70/316 X |

FOREIGN PATENT DOCUMENTS

| | | | |
|---|---|---|---|
| 89903 | 11/1922 | Austria | 70/316 |
| 101612 | 11/1925 | Austria | 70/328 |

*Primary Examiner*—Suzanne Dino
*Attorney, Agent, or Firm*—Pro-Techtor International

[57] ABSTRACT

A locating device for a numeral wheel of a numeral lock, comprising a lock body, several numeral wheels, notched wheels and springs, wherein a locating channel is formed on a surface of the notched wheel in front of projections thereof and a latch spring is disposed in the locating channel. The latch spring has upward projecting portions, whereby when the notched wheel is fitted into the numeral wheel, the projecting portions of the latch spring and the projections of the notched wheel are all engaged with recesses of the numeral wheel. When it is desired to adjust or change a lock code, a pushing pin is used to push the notched wheel backward so as to disengage the projections from the recesses while keeping the projecting portions of the latch spring resiliently engaged with the recesses. Therefore, the numeral wheel can be rotarily adjusted and located without totally disengaging from the notched wheel so as to avoid poor location and jumping of the numeral wheel.

3 Claims, 10 Drawing Sheets

LOCATING DEVICE FOR NUMERAL WHEEL OF NUMERAL LOCK

BACKGROUND OF THE INVENTION

The present invention relates to a locating device for a numeral wheel of a numeral lock, which enables the numeral wheel to be rotarily adjusted and located without totally disengaging from the notched wheel so as to avoid poor location and jumping of the numeral wheel.

A conventional numeral lock is shown in FIGS. 1 to 3. Several numeral wheels 2*a* are disposed on the surface of a lock body 1*a*. Only when the numeral wheels 2*a* are rotated and located in accordance with a preset lock code of the numeral wheels 2*a*, the lock body 1*a* can be unlocked. A spring 5*a* is used to abut against fixing leaf springs 6*a* with the protuberances 61*a* thereof engaged with a recessed edge 42*a* of a notched wheel 4*a* so as to create locating feeling during rotation. However, when the user wishes to reset the look code of the numeral wheels 2*a*, a pushing pin 3*a* is passed through a hole 11*a* of the lock body 1*a* into the interior thereof to push the notched wheel 4*a* fitted in the numeral wheel 2*a*. The notched wheel 4*a* has several projections 41*a* on the surface for engaging with the recesses formed on inner periphery of the numeral wheel 2*a*. Accordingly, the lock code can be reset by means of adjusting the engagement position between the projections 41*a* and the recesses 21*a*. As mentioned above, after the pushing pin 3*a* resiliently pushes the notched wheel 4*a* backward to make the projections 41*a* thereof disengage from the recesses 21*a* of the numeral wheel 2*a*, the numeral wheel 2*a* can be freely rotated and located at a desired position. Thereafter, the pushing pin 3*a* is removed from the notched wheel 4*a* and the notched wheel 4*a* is resiliently restored to its home position and again fitted into the numeral wheel 2*a*. Thereby, the lock code of the numeral wheel 2*a* is changed.

However, according to the above arrangements, after the pushing pin 3*a* pushes the notched wheel 4*a* and disengages the same from the numeral wheel 2*a*, the numeral wheel 2*a* becomes freely rotatable without any locating force. As a result, when rotating the first numeral wheel, the second one may be rotated therewith and when rotating the second numeral wheel, the third one may be rotated therewith. Therefore, after the user rotates the numeral wheel 2*a* to a new position and releases the notched wheel 4*a*, it is quite possible that the projections 41*a* of the notched wheel 4*a* are not aligned with the recesses 21*a* of the numeral wheel 2*a* to cause jumping of the numeral wheel and result in error of the reset lock code.

SUMMARY OF THE INVENTION

It is therefore a primary object of the present invention to provide a locating device for a numeral wheel of a numeral lock, wherein a locating channel is formed on a surface of the notched wheel in front of the projections thereof and a latch spring is disposed in the locating channel. The latch spring has upward projecting portions, whereby when the notched wheel is fitted into the numeral wheel, the projecting portions of the latch spring and the projections of the notched wheel are all engaged with the recesses of the numeral wheel. When it is desired to adjust or change a lock code, the pushing pin is used to push the notched wheel backward so as to disengage the projections from the recesses while keeping the projecting portions of the latch spring resiliently engaged with the recesses. Therefore, the numeral wheel can be rotarily adjusted and located without totally disengaging from the notched wheel and the projecting portions of the latch spring enable the user to perform the adjustment stage by stage. Therefore, after releasing the notched wheel, the lock code is accurately reset and the jumping of the numeral and difficulty in adjustment are eliminated.

The present invention can be best understood through the following description and accompanying drawing, wherein:

DETAILED DESCRIPTION OF THE PREFERRED EMBODIMENTS

Figure 1:
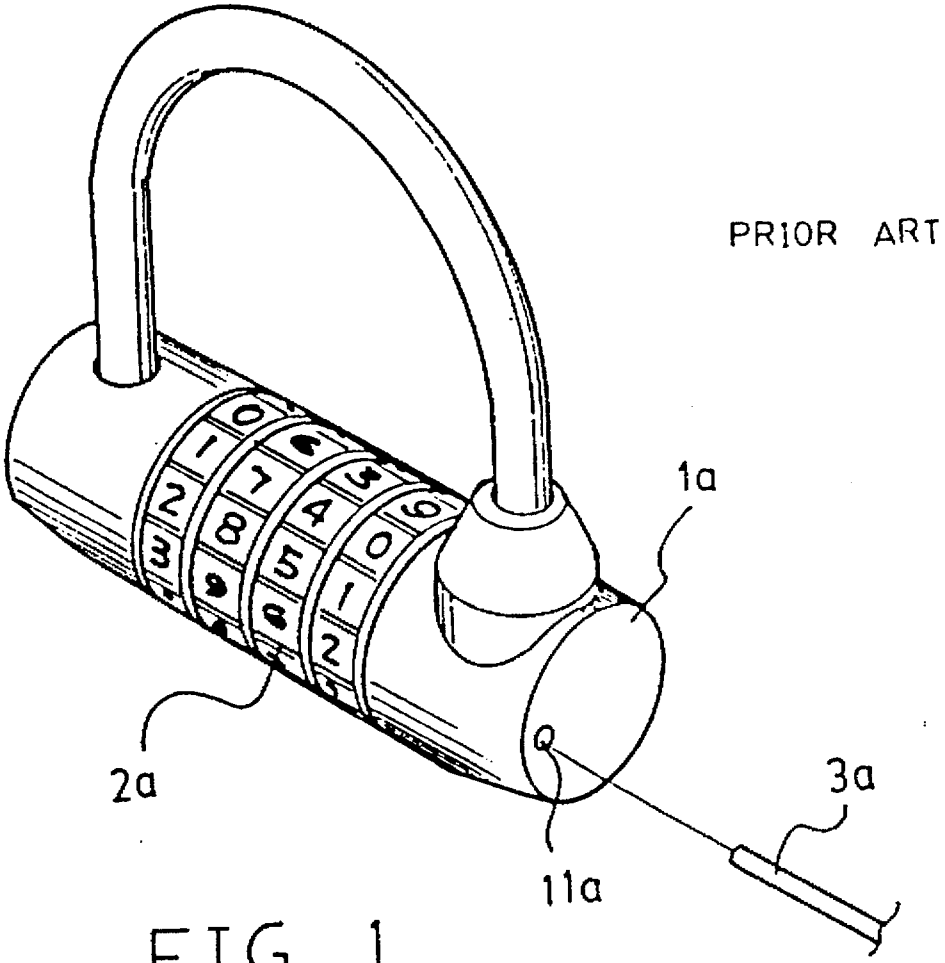
FIG. 1 is a perspective view of a conventional numeral lock.
Figure 2:
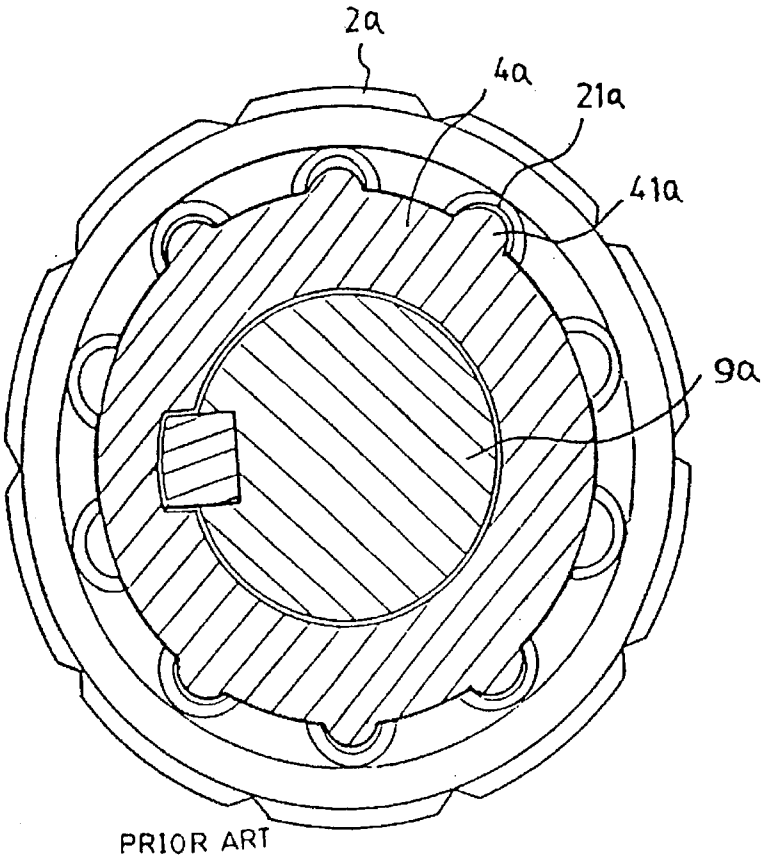
FIG. 2 is a cross-sectional view of the conventional numeral lock.
Figure 3:
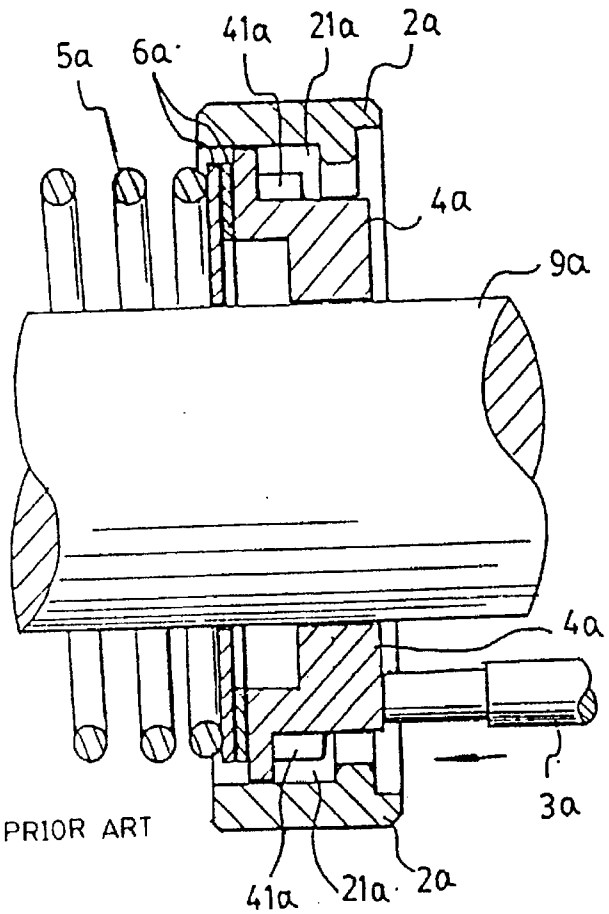
FIG. 3 is a side sectional view of the conventional numeral lock.
Figure 3A:
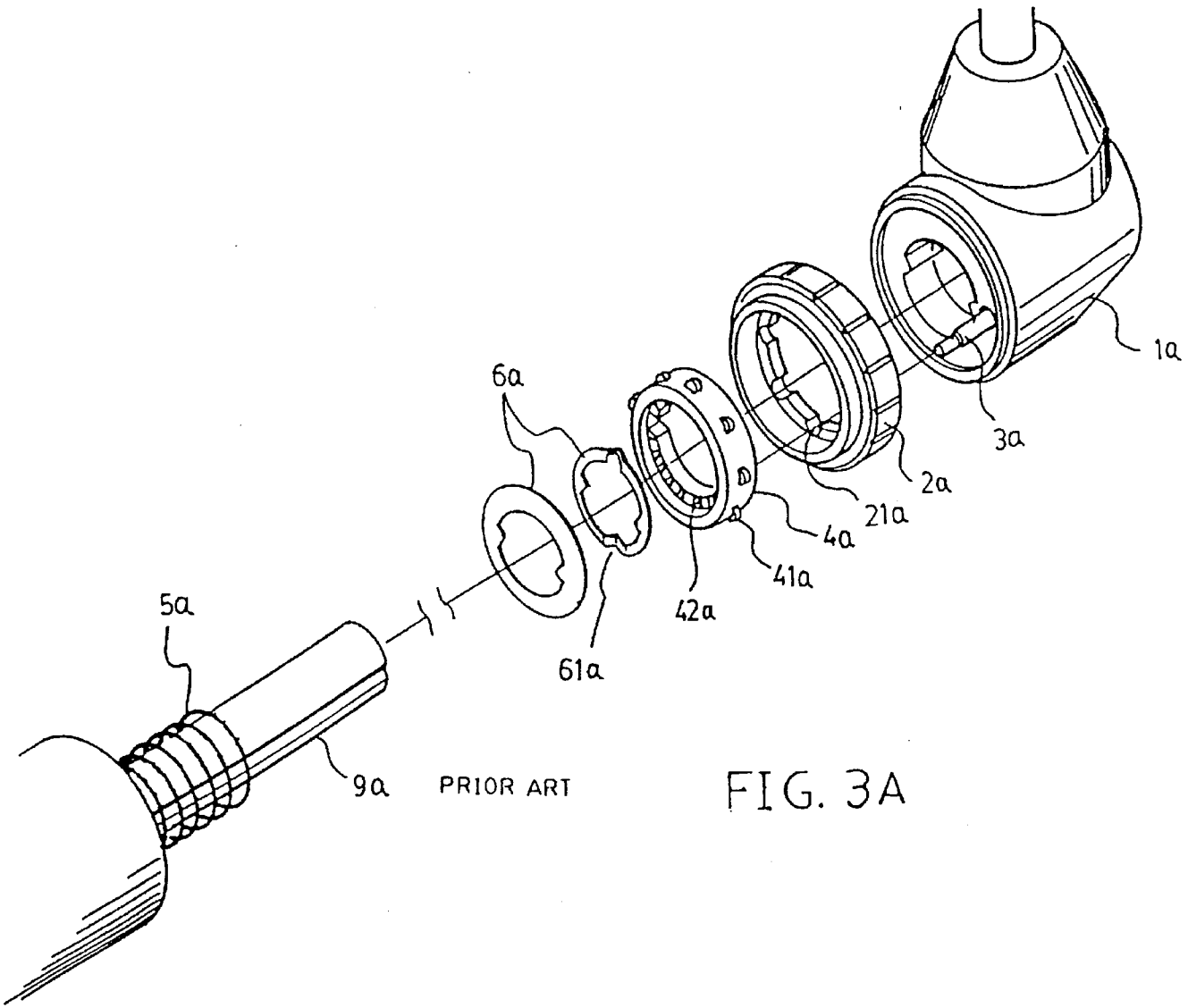
FIG. 3A PRIOR ART
FIG. 3A is a perspective exploded view of the conventional numeral lock.
Figure 4:
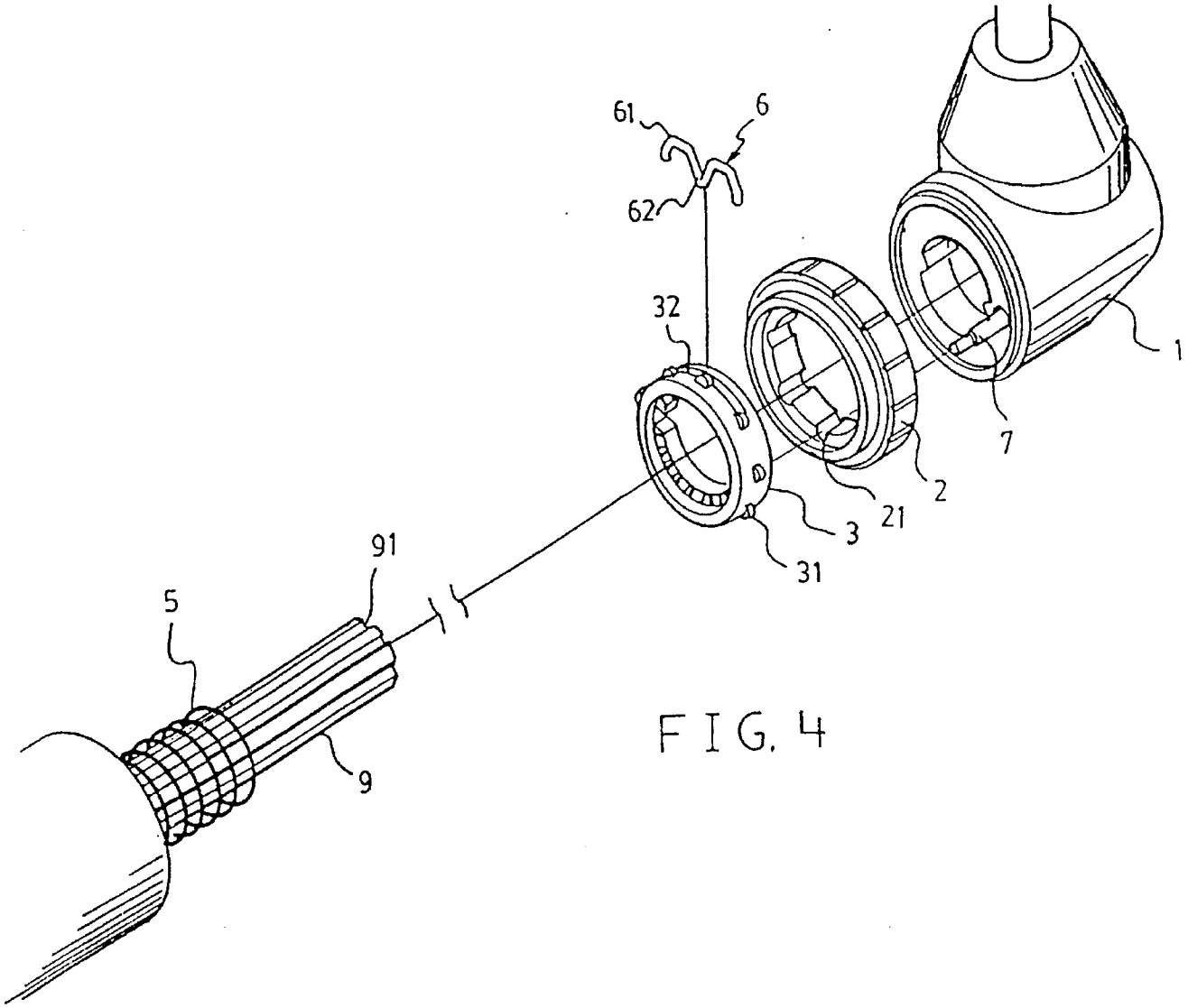
FIG. 4 is a perspective exploded view of an embodiment of the present invention.

Please refer to FIG. 4. The numeral wheel locating device of the present invention includes a conventional lock body 1, several numeral wheels 2, notched wheels 3 and springs 5.

Figure 5:
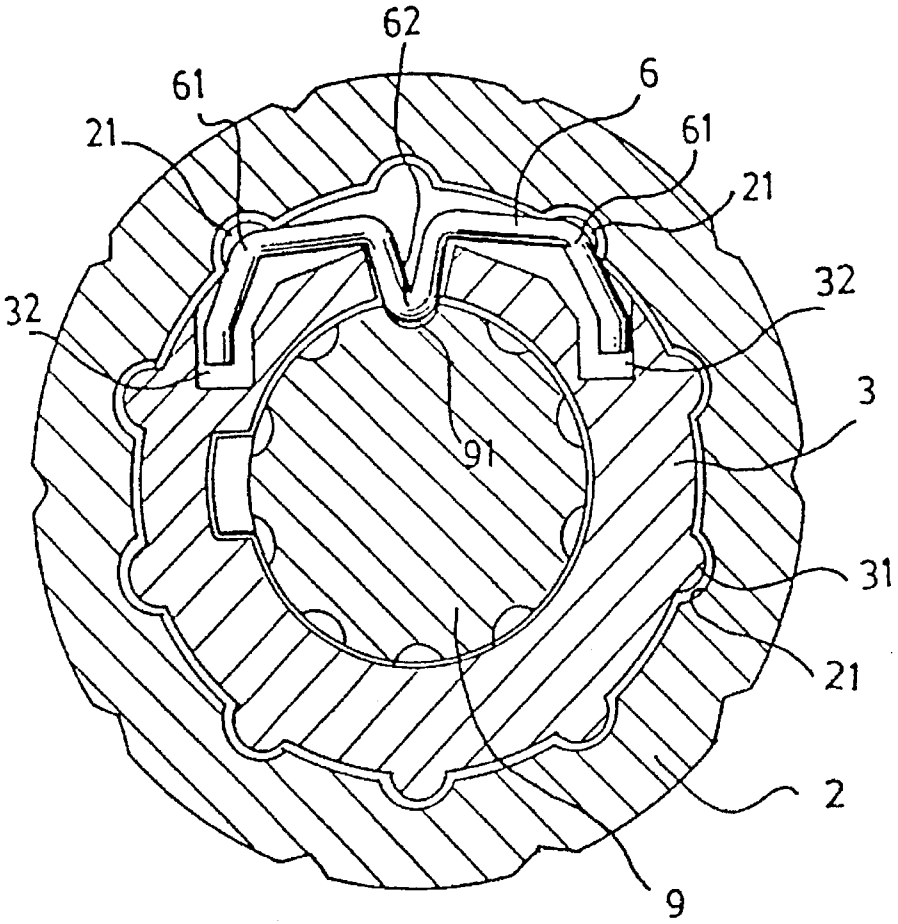
FIG. 5 is a cross-sectional view thereof.
Figure 6:
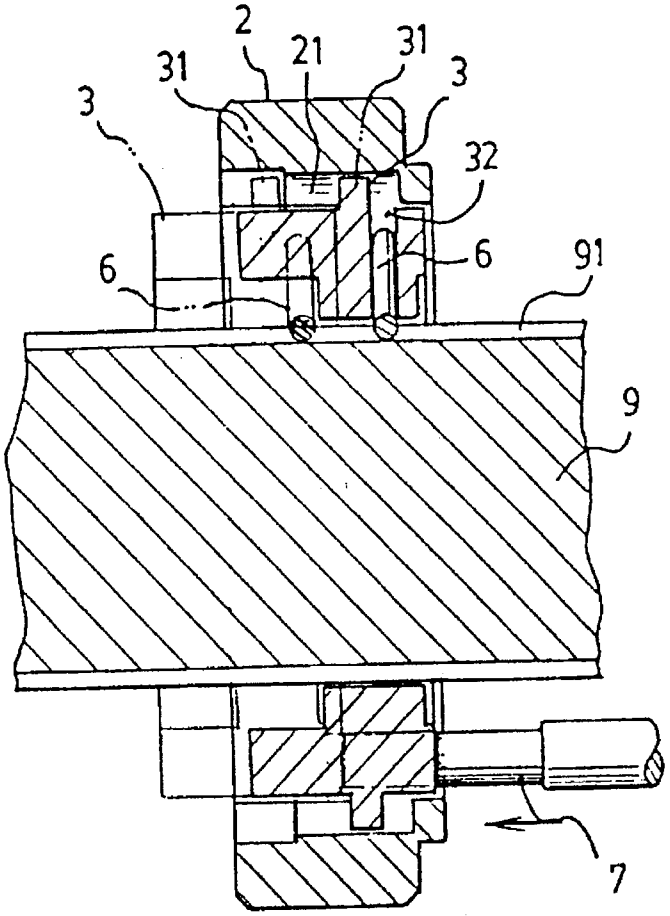
FIG. 6 is a side sectional view thereof.

Please refer to FIGS. 4 to 6. On the inner periphery of the numeral wheel 2 are formed several recesses 21 and on the outer periphery of the notched wheel 3 are formed several projections 31 for engaging with the recesses 21 so as to set the lock code of the numeral wheel 2. Only when the numeral wheel 2 is rotated to the set lock code, is the lock body 1 unlocked.

In order to eliminate the problem of jumping of the numeral which occurs in the conventional device when resetting the lock code, a locating channel 32 is formed on the surface of the notched wheel 3 and a latch spring 6 is disposed in the locating channel 32. The latch spring 6 is M-shaped, including two lateral shoulder portions 61 and a central V-shaped conic portion 62. The locating channel 32 is shaped corresponding to the latch spring 6 and is positioned axially slightly in front of the projections 31, whereby when the notched wheel 3 is fitted into the numeral wheel 2, the projecting shoulder portions 61 of the latch spring 6 and the projections 31 of the notched wheel 3 are all engaged with the recesses 21 of the numeral wheel 2. At this time, the central V-shaped conic portion 62 of the latch spring 6 is engaged with a flute 91 of a shaft 9 of the lock body 1 so as to lock the notched wheel 3 with the shaft 9, whereby when a user rotates the numeral wheel 2, by means of the engagement between the V-shaped conic portion 62 and the flute 91 of the shaft 9, the user can feel that each numeral is for one location. However, when it is desired to adjust or change the lock code, a pushing pin 7 is used to push the notched wheel 3 backward as shown by phantom line of FIG. 6 so as to disengage the projections 31 from the recesses 21 while keeping the shoulder portions 61 of the latch spring 6 resiliently engaged with the recesses 21 as shown in FIGS. 5 and 6. Therefore, by means of the resilient engagement between the shoulder portions 61 of the latch spring 6 and the recesses 21, the notched wheel 3 is prevented from separating from the numeral wheel 2 and because the notched wheel 3 is still locked with the shaft 9, the notched wheel 3 will not rotate relative to the shaft 9. However, since the projections 31 are disengaged from the recesses 21, the numeral wheel 2 can be rotated relative to the notched wheel 3 for resetting the lock code. At this time, by means of the resilient engagement between the shoulder portions 61 of the latch spring 6 and the recesses 21, the numeral wheel 2 is rotated and located on a stage by stage basis, that is, the user can clearly recognize the rotation and location of the numeral wheel 2. After adjusted, the notched wheel 3 is released and the projections 31 thereof can be accurately re-engaged with and located in the recesses 21 without jumping of the numeral or difficulty in operation. The shaft 9 can be designed with different shapes in cross-section. For example, the cross-section of the shaft 9 can be hexagonal or octagonal to suit the V-shaped conic portion 62 of the M-shaped latch spring 6. However, the shape of the cross-section of the shaft 9 is not limited and all those which can cooperate with the conic portion 62 should be included in the scope of the present invention.

Figure 7:
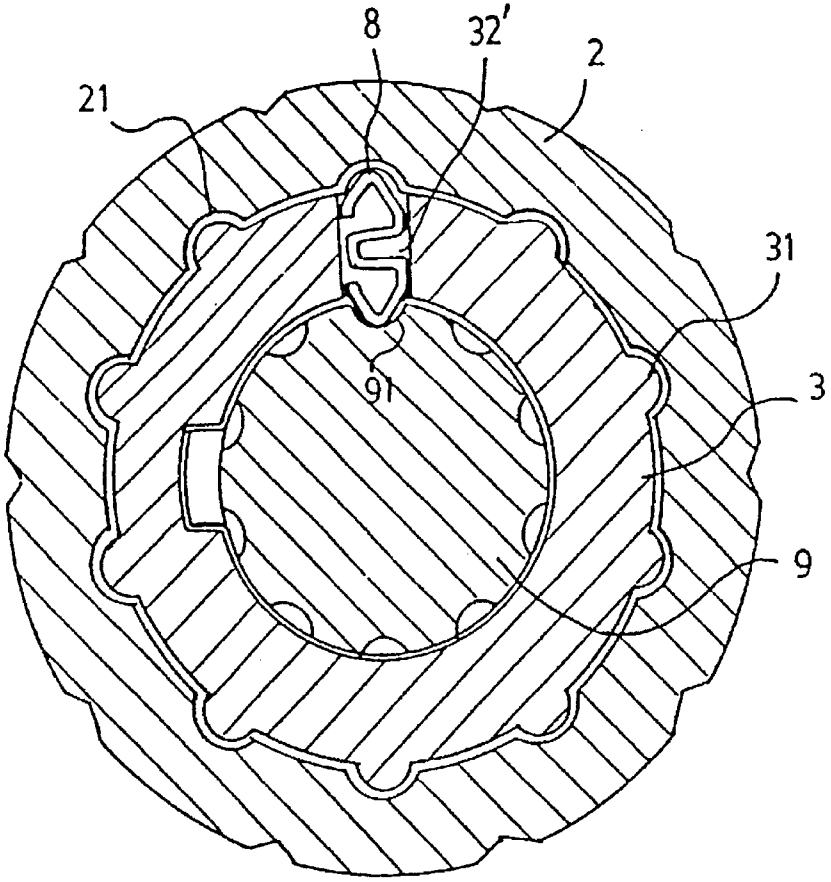
FIG. 7 is a cross-sectional view showing another embodiment of the present invention which includes a bow-like latch spring.
Figure 8:
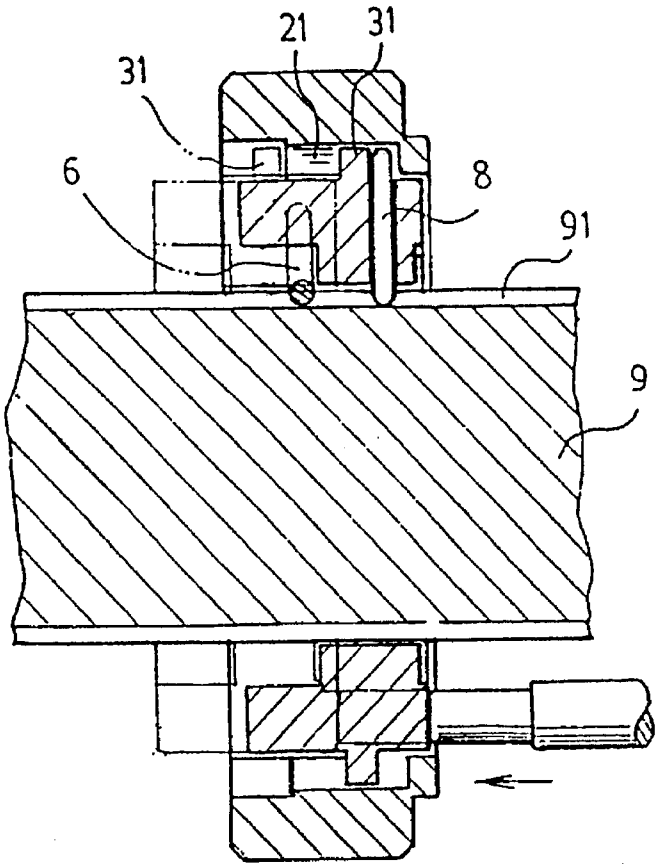
FIG. 8 is a side sectional view according to FIG. 7.

Moreover, please refer to FIGS. 7 and 8 which show another embodiment of the present invention, wherein the latch spring 8 is substantially bow-like and the notched wheel 3 is formed with a radial locating tunnel 32' cooperating with the bow-like latch spring 8. The latch spring 8 has an upper projecting portion for resiliently engaging with the recess 21 of the numeral wheel 2 and a lower projecting portion for resiliently engaging with the flute 91 of the shaft 9 to achieve the same function as the forgoing M-shaped latch spring 6.

Figure 9:
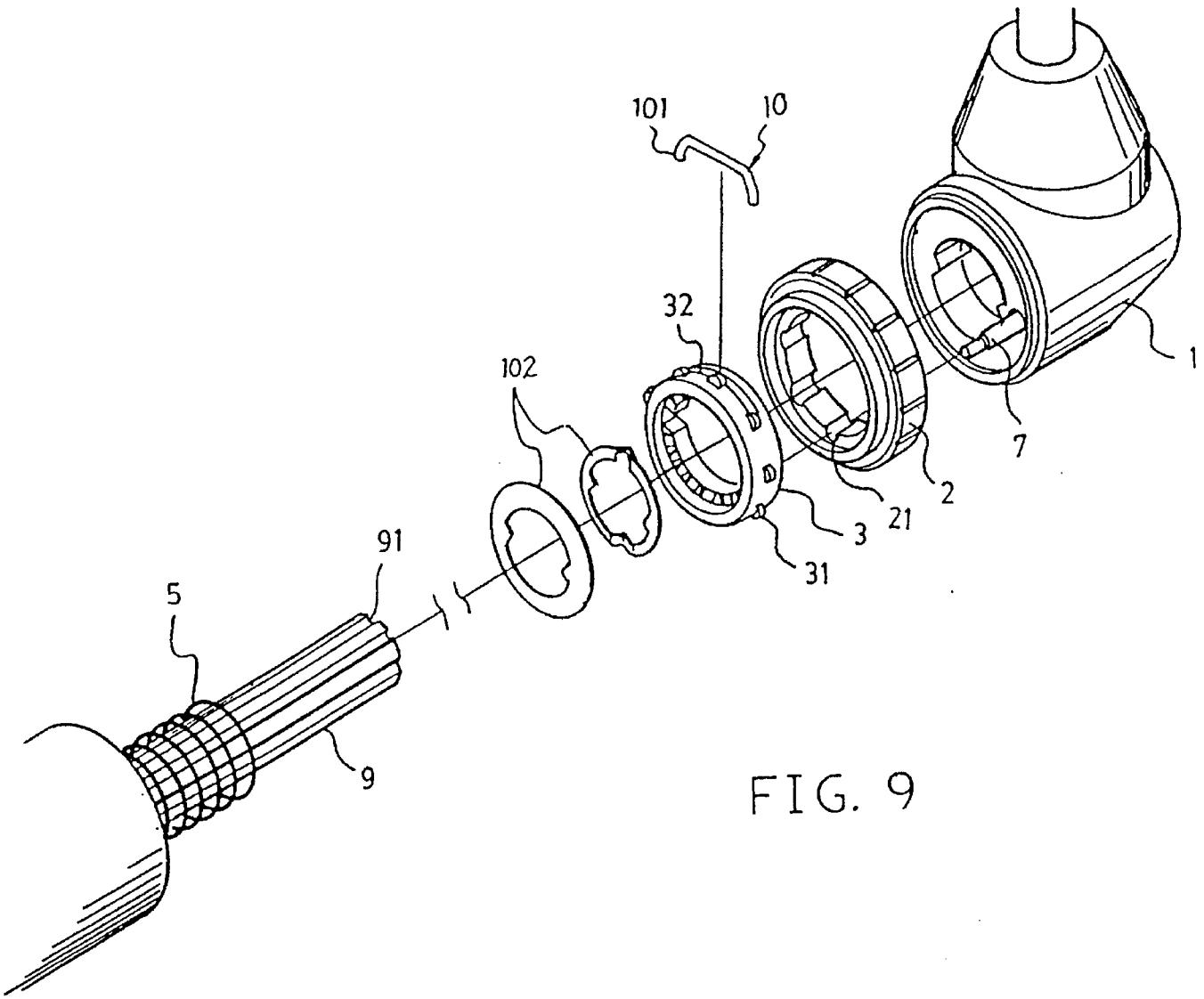
FIG. 9 is a perspective exploded view of still another embodiment of the present invention which includes a U-shaped latch spring.
Figure 10:
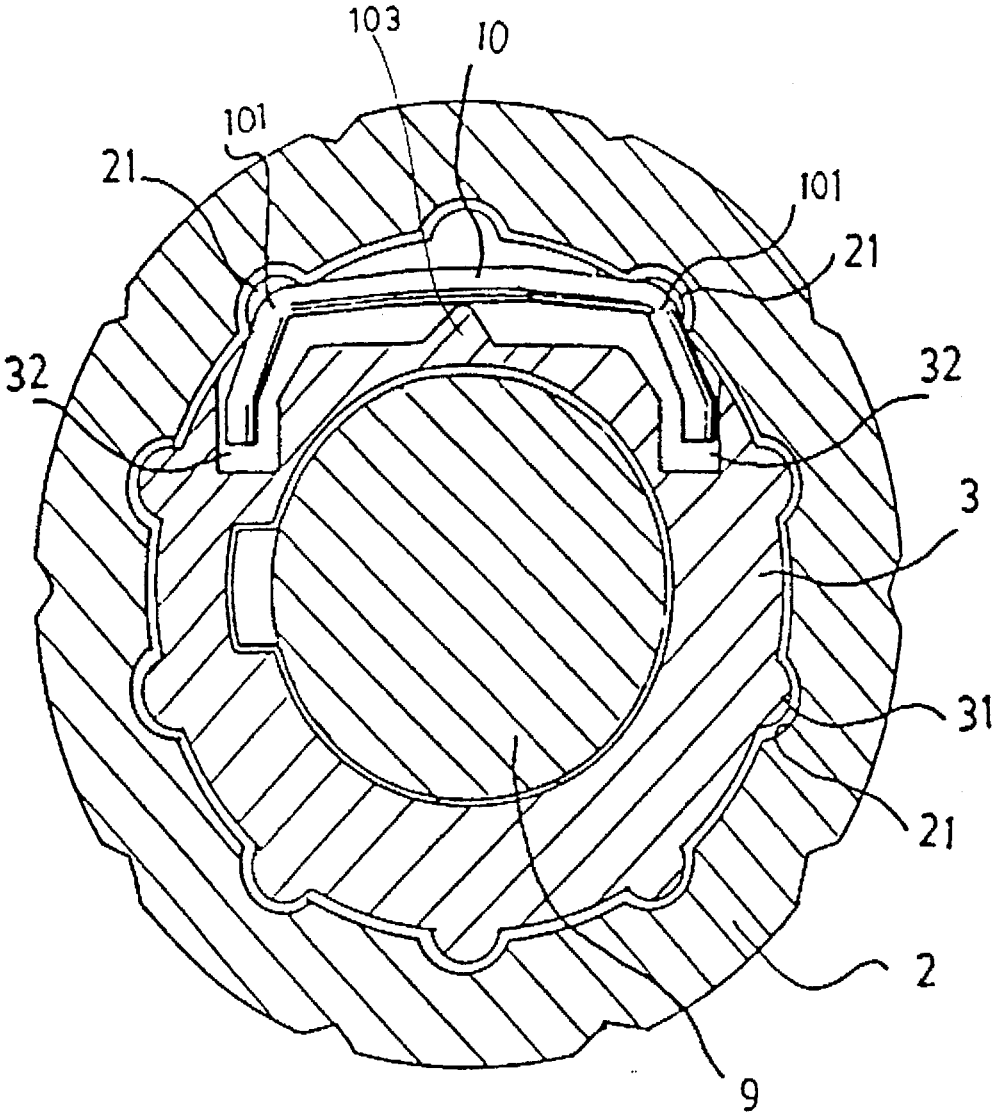
FIG. 10 is a cross-sectional view according to FIG. 9.

FIGS. 9 and 10 show still another embodiment of the present invention, wherein the latch spring 10 is U-shaped, having two lateral shoulder portions 101 which engage with the recesses 21 of the numeral wheel 2 as the projections 31 do. A projecting fulcrum 103 is formed on the surface of the notched wheel 3 under a center of the latch spring 10 for supporting the same. In order to securely lock the notched wheel 3 with the shaft 9, fixing leaf springs 102 are disposed beside the notched wheel 3 for the spring 5 to abut against the leaf springs 102 so as to lock the notched wheel 3. The U-shaped latch spring 10 cooperates with the conventional leaf springs 102 to achieve the same function as the forgoing M-shaped latch spring 6.

Figure 11:
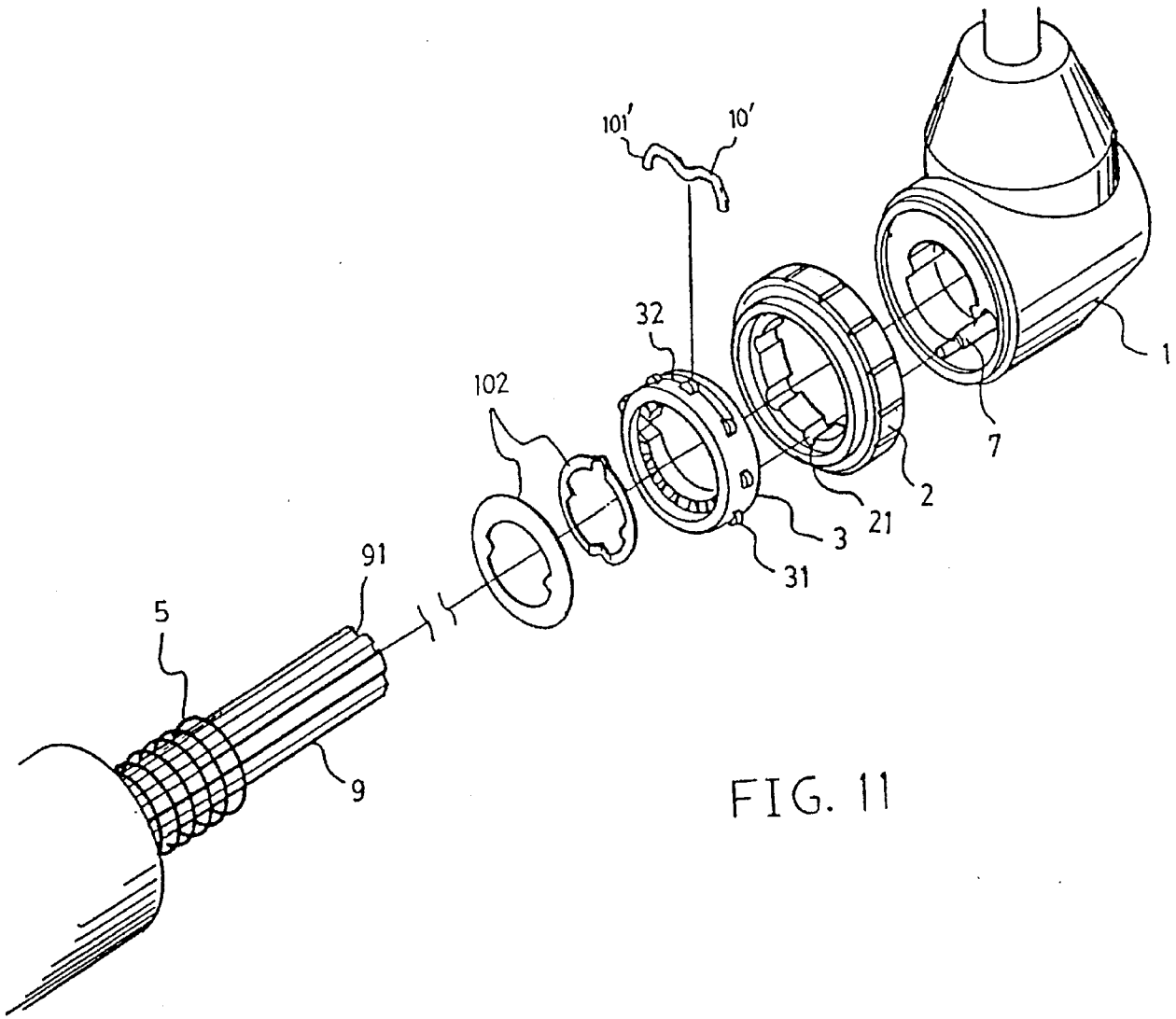
FIG. 11 is a perspective exploded view of still another embodiment of the present invention.
Figure 12:
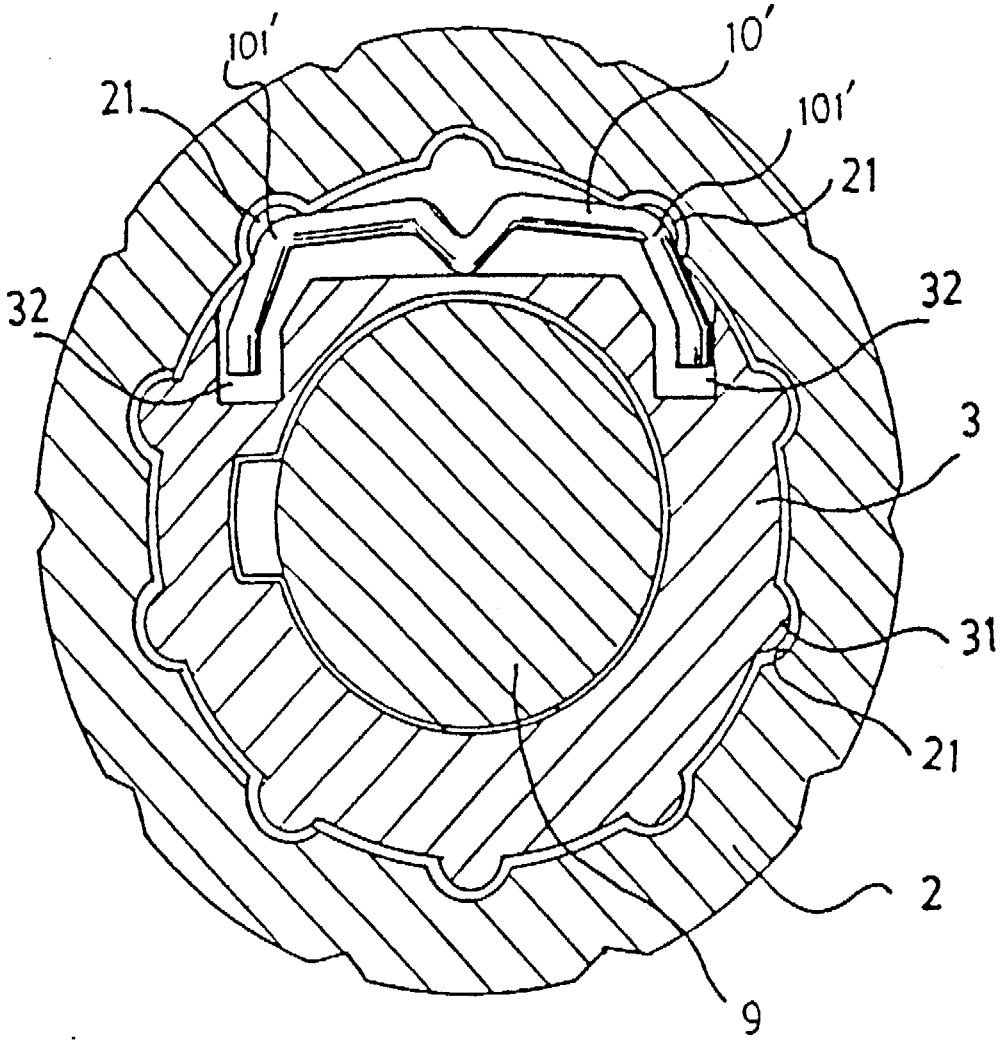
FIG. 12 is a cross-sectional view according to FIG. 11.

Finally, please refer to FIGS. 11 and 12 which show still another embodiment of the present invention, wherein the latch spring 10' is substantially M-shaped, having two lateral shoulder portions 101' for engaging with the recesses 21 of the numeral wheel 2. In addition, the latch spring 10' is formed with a V-shaped fulcrum at the central portion which is supported on a central portion of a surface of the notched wheel 3. Similar to the above mentioned embodiment, the fixing leaf springs 102 are disposed beside the notched wheel 3 for locking the same.

In conclusion, the numeral wheel locating device of the present invention employs the resilient latch spring so that when resetting the lock code of the numeral lock, the numeral wheel is rotarily adjusted in position and located stage by stage without totally disengaging from the notched wheel. Therefore, the present invention not only avoids jumping of the numeral but also facilitates the operation and recognition of the numeral lock.

It is to be understood that the above description and drawings are only used for illustrating one embodiment of the present invention, not intended to limit the scope thereof. Any variation and derivation from the above description and drawings should be included in the scope of the present invention.

What is claimed is:

1. A locating device for a numeral wheel of a numeral lock, comprising:

a lock body, a plurality of numeral wheels, notched wheels, and springs, wherein on an inner periphery of each said numeral wheel are formed several recesses and on an outer periphery of each said notched wheel are formed several projections for engaging with said recesses, a locating channel is formed on a surface of each said notched wheel and a latch spring is disposed in said locating channel, each said latch spring having upward projecting portions slightly protruding beyond said locating channel, each said notched wheel being locked with a shaft of said lock body, said locating channel being positioned axially slightly in front of said projecting portions, whereby when each said notched wheel is fitted into a corresponding numeral wheel, said projecting portions of said latch spring and said projections of each said notched wheel are all engaged with said recesses of said corresponding numeral wheels and when it is desired to adjust or change a lock code, each said notched wheel is pushed backward so as to disengage said projections from said recesses while keeping said projecting portions of said latch spring resiliently engaged with said recesses, and wherein said latch spring is M-shaped, including two lateral upward projecting portions and a central V-shaped downward projecting conic portion, said conic portion fits into a flute of said shaft of said lock body so as to lock each said notched wheel with said shaft.

2. The locating device as claimed in claim 1 wherein:

each said latch spring is U-shaped, having two lateral shoulder portions for engaging with said recesses of each said numeral wheel, a projecting fulcrum being formed on a surface of each said notched wheel under a center of each said latch spring for supporting each said latch spring, fixing leaf springs being disposed beside each said notched wheel for a corresponding latch spring to abut against said leaf springs so as to lock each said notched wheel.

3. The locating device as claimed in claim 1 wherein:

each said latch spring is substantially M-shaped, having two lateral shoulder portions for engaging with said recesses of each said numeral wheel and a central V-shaped fulcrum supported on a central portion of each said notched wheel, fixing leaf springs being disposed beside each said notched wheel for locking each said notched wheel.

* * * * *